US006732878B2

(12) United States Patent
Gillen

(10) Patent No.: US 6,732,878 B2
(45) Date of Patent: May 11, 2004

(54) VENTING LID APPARATUS FOR TANK OPENING

(75) Inventor: Mark E. Gillen, Zionsville, IN (US)

(73) Assignee: Banjo Corporation, Crawfordsville, IN (US)

( * ) Notice: Subject to any disclaimer, the term of this patent is extended or adjusted under 35 U.S.C. 154(b) by 0 days.

(21) Appl. No.: 09/804,823

(22) Filed: Mar. 13, 2001

(65) Prior Publication Data

US 2002/0011493 A1 Jan. 31, 2002

Related U.S. Application Data

(63) Continuation-in-part of application No. 09/628,153, filed on Jul. 28, 2000, now abandoned.

(51) Int. Cl.[7] ..... B65D 51/16

(52) U.S. Cl. ..... 220/373; 220/367.1; 220/288; 220/565; 220/4.13; 220/582; 220/303; 220/304; 220/913; 220/203.19; 220/203.29

(58) Field of Search ..... 217/98, 4, 74, 217/76; 105/377.01, 377.07; 220/601, 565, 567.2, 4.12, 4.13, 582, 203.01–203.06, 203.09, 203.19, 203.29, 288, 293, 303, 360, 366.1, 367.1, 373, 374, 368, 89.1, 913, 304; 215/307, 260, 274

(56) References Cited

U.S. PATENT DOCUMENTS 1,351,496 A * 8/1920 Spooner ..... 215/329
3,927,798 A 12/1975 Loomis (List continued on next page.)

OTHER PUBLICATIONS

Banjo Corporation, "Engineering Drawing of Vent Cap.,", (Sep. 8, 1998).

(List continued on next page.)

*Primary Examiner*—Robin A. Hylton
(74) *Attorney, Agent, or Firm*—Baker & Daniels

(57) ABSTRACT

A lid apparatus for a tank opening that retains fluid within the tank while allowing air to vent into or out of the tank. An air manifold is provided, preferably as part of an installation ring of the apparatus which is mounted to the tank around the tank opening. The air manifold has an outer radial wall and an inner radial wall spanned by an annular base surface. A plurality of angularly spaced openings in the outer radial wall are angularly offset from a plurality of openings in the inner radial wall to be out of angular alignment therewith, and the space above the annular base surface between the outer radial wall openings and the inner radial wall openings provides a plurality of air flow passageways. A cap of the apparatus has a cover portion and a depending mounting member adapted to insert within the installation ring and engage a cap mounting portion of that ring to detachably mount the cap to the installation ring. A plurality of angularly spaced vent openings in the cap mounting member are in angular alignment with the inner radial wall openings when the cap is mounted to the installation ring to promote tank venting through the air manifold. Splash guards inward of the vent openings serve to limit fluid from splashing through the vent openings into the manifold. Additional openings in the manifold inner wall that are angularly aligned with openings in the manifold outer wall are also provided to enhance venting, and the additional openings are separated from the aligned outer wall openings by upstanding diverter plates that also block fluid from splashing radially outward through the manifold.

31 Claims, 12 Drawing Sheets

U.S. PATENT DOCUMENTS

| | | | | | |
|---|---|---|---|---|---|
| 4,036,393 | A | * | 7/1977 | Neiman | 220/203.05 |
| 4,091,180 | A | * | 5/1978 | Fox et al. | 220/374 |
| 4,165,816 | A | | 8/1979 | Tupper | |
| 4,460,101 | A | * | 7/1984 | Tseng | 215/307 |
| 4,512,499 | A | | 4/1985 | Uuskallio | |
| 4,693,393 | A | * | 9/1987 | DeMinco et al. | 220/374 |
| 4,768,677 | A | | 9/1988 | Kitsukawa | |
| 4,884,716 | A | | 12/1989 | Steiner | |
| 4,971,219 | A | | 11/1990 | Dombeck et al. | |
| 5,160,054 | A | | 11/1992 | Nolte | |
| 5,203,466 | A | | 4/1993 | Kasugai et al. | |
| 5,242,072 | A | | 9/1993 | Koebernik | |
| 5,277,327 | A | | 1/1994 | Nakano et al. | |
| 5,558,244 | A | | 9/1996 | Akaike et al. | |
| 5,875,915 | A | * | 3/1999 | Bradshaw et al. | 220/288 |
| 5,908,129 | A | | 6/1999 | Schutz | |

OTHER PUBLICATIONS

Arag Spraying and Irrigation, Rubiera, Italy., "Catalog C101A 01, pp. 77–90,", (Oct. 12, 1998).

Photographs, "Vent Caps, photographs marked as Fig. 1A, Fig. 1B, Fig. 1C, and Fig. 1D,".

Photographs, "Vent Caps, photographs marked as Fig. 2A and Fig. 2B,".

Photographs, "Vent Caps, photographs marked as Fig. 3A and Fig. 3B,".

Photographs, "Vent Caps, photographs marked as Fig. 4A and Fig. 4B.,".

Photographs, "Vent Caps, Photographs marked as Fig. 5A and Fig. 5B,".

Photographs, "Vent Caps, photographs marked as Fig. 6A, 6B and 6C.,".

Photographs, "Vent Caps, photographs marked as Fig. 7A and 7B.,".

Photographs, "Vent Caps, photographs marked as Fig. 8A and Fig. 8B.,".

* cited by examiner

VENTING LID APPARATUS FOR TANK OPENING

REFERENCE TO RELATED APPLICATION

The present application is a continuation-in-part of application Ser. No. 09/628,153, filed on Jul. 28, 2000, now abandoned entitled "Venting Lid Apparatus For Tank Opening."

BACKGROUND OF THE INVENTION

The present invention relates to tank lids, and, in particular, to a tank lid with venting capabilities.

A wide assortment of tank lids are known which are used to cover access openings in tanks to prevent the tank contents from splashing out, such as when the tanks are being moved from site to site. Many of these prior art lids are designed to provide venting capabilities, whereby air is allowed to pass into and/or out of the tank interior without requiring the lid to be removed from the tank.

One known venting lid apparatus includes an installation ring that is mountable to a tank and which is internally threaded to receive a lid apparatus cover. The cover, which has a diameter of approximately eighteen inches, includes a keyed central opening of approximately four inches in diameter, which opening receives a capping insert that provides the cover with its venting capabilities. In particular, a pair of cylindrical tubes opened at both their top and bottom ends extend downward from the insert, and separate stepped baffles are assembled to the insert within each of the tubes. The stepped baffles provide a circuitous route through which air can pass, but for which fluid will be unlikely to pass through to escape from the tank. The top ends of the baffle-lined tubes open into a venting chamber defined by a protrusion which serves as a grip that allows rotation of the insert to secure it to the remainder of the cover, and exposed openings at diametrically opposite ends of the protrusion allow air to reach the tubes.

In another known venting lid apparatus, an eighteen inch diameter cover is rotatably mounted on a bracket which is hinged to an installation ring that is mountable to a tank. The installation ring is internally threaded to receive the cover. At its upper end, the bracket includes a downwardly extending, externally threaded cylinder with a closed off top end that inserts through a less than three inch diameter central opening in the cover. A separate stepped baffle fits within the cylinder from below and is retained by an annular collar that screws onto the end of the cylinder beneath the cover. When the cover is screwed to the installation ring, air that flows under the bracket can flow through diametrically aligned gaps in an upper surface rim of the cover around the central opening, into the cylinder through diametrically arranged holes in the upper regions of the cylinder wall aligned with the rim gaps, and out through the bottom of the cylinder and into the tank interior after passing through the stepped baffle.

While perhaps of limited utility, the two above-described venting lid apparatuses suffer from shortcomings that reduce their desirability. For example, the multi-part design of their covers may result in higher costs associated with assembly which may be passed along to the end user. Moreover, the number of interconnected parts increases the possibility of part failure over time that can compromise the effectiveness of the product.

In many other types of known venting lid apparatuses, a cover mountable over an opening in the tank is provided with one or more apertures at or near its center, which aperture is provided with a device to limit fluid passage while allowing air venting. For example, in some designs, the cover aperture opens into a tube that is formed integrally with the underside of the cover, and a separate, stepped baffle is secured within the tube and includes a laterally venting top cap portion that extends above the cover and overlays the aperture. In another design, a central aperture is fitted with a rubber member configured to serve as a one-way valve that allows air to enter into the interior of the tank, but prevents fluid from exiting the tank. In still another design, two centrally located, small apertures are covered from below by a single, large flexible disc which prevents materials in the tank from passing vertically through the apertures, but which allows air that enters the cover apertures from above to flow radially along the disc and over the circular periphery of the disc to pass into the tank interior. While these prior art products may be less complicated in design than certain other known venting lid apparatuses, they still possess shortcomings due to the fact that multiple, assembled parts are required to form the cover.

Another dilemma facing the lid manufacturing industry has been to provide a lid with sufficient venting capabilities without unduly comprising the ability of that lid to keep the fluid from splashing out. When a lidded tank is emptied through an outlet, unless enough air is allowed into the tank through the tank lid to replace the emptied volume of fluid, the vacuum effect created can slow the fluid discharge or, in some cases in which the tank is not of sufficient strength, possibly cause the tank to collapse upon itself. Many tank lids simply do not vent well enough for certain applications, such as those requiring large flow rates.

Thus, it would be desirable to provide a venting lid apparatus that overcomes these and other deficiencies of the prior art.

SUMMARY OF THE INVENTION

The present invention provides a venting lid apparatus that retains fluid within a tank while allowing air to vent into or out of the tank. The apparatus includes a cap with vent holes spaced around the circumference of its mounting flange to provide a relatively large area through which air may pass to vent the tank, and with splash guards to limit fluid splashing through the vent holes. An annular air manifold, preferably provided on a ring into which the cap inserts, is in communication with the cap vent holes. The manifold defines air venting passageways having openings in the manifold outer wall that are angularly spaced from openings in the manifold inner wall. As a result of the angular spacing of the openings, fluid splashing in a radial direction through an opening in the manifold inner wall that serves as an air outlet strikes the manifold outer wall and does not directly pass through the manifold. Additional openings in the inner manifold wall that are angularly aligned with openings in the manifold outer wall are separated from these aligned openings by upstanding diverter plates that also block fluid splashing radially outward. The manifold passageways allow large volumes of air to flow into and out of the tank with which the lid apparatus is used, while at the same time providing a circuitous pathway for fluid that aids in preventing splashing fluid from escaping from within the tank.

In one form thereof, the present invention provides a venting lid apparatus for a fluid container opening, including a cap and a cap receiving element. The cap includes a cover portion and an insert member depending from the cover portion and which includes a plurality of angularly spaced vent openings. The cap receiving element is either integrally formed with or assembled to the fluid container in registry with the fluid container opening, and includes a portion defining an opening into which inserts the cap insert member. At least one of the cap and the cap receiving element form an air manifold including a first surface and a second surface radially outward of the first surface. The first surface defines a plurality of angularly spaced openings in air flow communication with the plurality of angularly spaced vent openings when the cap is installed on the cap receiving element. The second surface defines at least one opening angularly spaced from the plurality of first surface openings, and the at least one second surface opening is in air flow communication with the plurality of first surface openings for tank venting.

In another form thereof, the present invention provides a venting lid apparatus for a fluid container opening, including a cap and a cap receiving element. The cap includes a cover portion and an insert member depending from the cover portion. The insert member includes a plurality of angularly spaced vent openings. The cap receiving element is either integrally formed with or assembled to the fluid container in registry with the fluid container opening, and includes a portion defining an opening into which inserts the cap insert member. At least one of the cap and the cap receiving element form an air manifold including a first surface extending in an axial direction and a second surface extending in the axial direction and disposed radially outward of the first surface. The first surface defines a plurality of angularly spaced openings in air flow communication with the plurality of angularly spaced vent openings when the cap is installed on the cap receiving element. The second surface defines a plurality of angularly spaced openings that are located in angular alignment with the plurality of first surface openings and in air flow communication with the plurality of first surface openings for tank venting. The manifold includes a plurality of axially extending diverter elements each positioned at a radial location between and in angular alignment with one of the plurality of first surface openings and one of the plurality of second surface openings. Each diverter element has a size and placement to block fluid from passing outward in a radial direction from the one of the first surface openings to the one of the second surface openings.

In another form thereof, the present invention provides a venting lid apparatus for a fluid container opening, including a cap and a cap receiving element. The cap includes a cover portion and a mounting member depending from the cover portion, which mounting member includes at least one cap fastening element. The cap receiving element is one of integrally formed with and assembled to the fluid container in registry with the fluid container opening, and includes a cap mounting portion and an air manifold. The cap mounting portion defines an opening and is adapted to cooperate with the cap fastening element to detachably mount the cap to the cap receiving element when the cap mounting member inserts within the cap mounting portion opening. At least a portion of the air manifold is disposed radially outward of the cap mounting portion, and the manifold includes a first surface and a second surface radially outward of the first surface. The first surface defines a plurality of angularly spaced openings, and the second surface defines at least one opening angularly spaced from the plurality of first surface openings. The at least one second surface opening is in air flow communication with the plurality of first surface openings for tank venting.

In another form thereof, the present invention provides a venting lid apparatus for a fluid container opening, including a cap and a cap receiving element. The cap includes a cover portion and a mounting member depending from the cover portion, which mounting member includes at least one cap fastening element. The cap receiving element is one of integrally formed with and assembled to the fluid container in registry with the fluid container opening, and includes a cap mounting portion and an air manifold. The cap mounting portion defines an opening and is adapted to cooperate with the at least one cap fastening element to detachably mount the cap to the cap receiving element when the cap mounting member inserts within the cap mounting portion opening. The air manifold includes a first surface extending in an axial direction and a second surface extending in the axial direction and disposed radially outward of the first surface. The first surface defines a plurality of angularly spaced openings, and the second surface defines a plurality of angularly spaced openings that are located in angular alignment with the plurality of first surface openings and in air flow communication with the plurality of first surface openings for tank venting. The manifold includes a plurality of axially extending diverter elements each positioned at a radial location between and in angular alignment with one of the plurality of first surface openings and one of the plurality of second surface openings. Each diverter element has a size and placement to block fluid from passing outward in a radial direction from the first surface opening to the second surface opening.

In another form thereof, the present invention provides a venting cap for an opening in a fluid container, including a cover portion for covering the fluid container opening, an annular mounting member depending from the cover portion and having at least one vent opening therethrough, a fastener disposed on the mounting member and adapted to detachably mount the cover portion to a complementary fastener portion in registry with the fluid container opening, and at least one splash guard between the at least one vent opening and a center region of the cover portion.

In still another form thereof, the present invention provides a venting lid apparatus for a fluid container opening, including an installation ring and a cap. The installation ring is attachable to the fluid container with an opening of the ring in registry with the fluid container opening. The installation ring includes a cap mounting portion and an annular air manifold. The air manifold has an outer radial wall and an inner radial wall spanned by an annular base surface. The inner radial wall has a plurality of angularly spaced openings, and the outer radial wall has a plurality of angularly spaced openings each angularly offset from the plurality of openings in the inner radial wall to be out of angular alignment therewith. The space above the annular base surface between the plurality of openings in the outer radial wall and the plurality of openings in the inner radial wall provides a plurality of air flow passageways. The cap has a cover portion and a mounting member depending from the cover portion. The mounting member is adapted to insert within the installation ring opening and engage the cap mounting portion to detachably mount the cap to the installation ring. The mounting member includes a plurality of angularly spaced vent openings in angular alignment with the plurality of openings in the inner radial wall when the cap is mounted to the installation ring.

One advantage of the venting lid apparatus of the present invention is that it may be made in only two parts, or possibly even a single part if the tank with which it is used is made with cover mounting capabilities.

Another advantage of the venting lid apparatus of the present invention is that its molded component part or parts do not require post-molding manufacturing or assembling operations prior to use.

Another advantage of the venting lid apparatus of the present invention is that its venting capabilities accommodate large volumes of fluid entering and exiting the tank with which it is used.

Another advantage of the venting lid apparatus of the present invention is that it can be made out of a single material, which material may be similar in nature to the tank with which the apparatus is used to ensure compatibility with the materials in the tank.

Another advantage of the present invention is that the venting lid apparatus has no moving parts subject to failure.

Another advantage of the present invention is that a venting lid apparatus is provided that can be installed on a tank without requiring any special threads or other attachments be on the tank prior to installation.

Another advantage of the present invention is that the venting lid apparatus has a simple design which achieves a fluid hold-back without the use of a foam or other porous material, and which is easy to clean and has minimal obstructions in the interior of the cover.

Still another advantage of the venting lid apparatus of the present invention is it will vent a tank without requiring any interaction with the person using the tank, as nothing is required to be unscrewed or otherwise actuated for the vent to operate.

Still another advantage of the venting lid apparatus of the present invention is that it can be economically made for large openings on larger sized tanks.

DESCRIPTION OF THE FIGURES

The above mentioned and other advantages and objects of this invention, and the manner of attaining them, will become more apparent and the invention itself will be better understood by reference to the following descriptions of embodiments of the invention taken in conjunction with the accompanying drawings, wherein.

Figure 1:
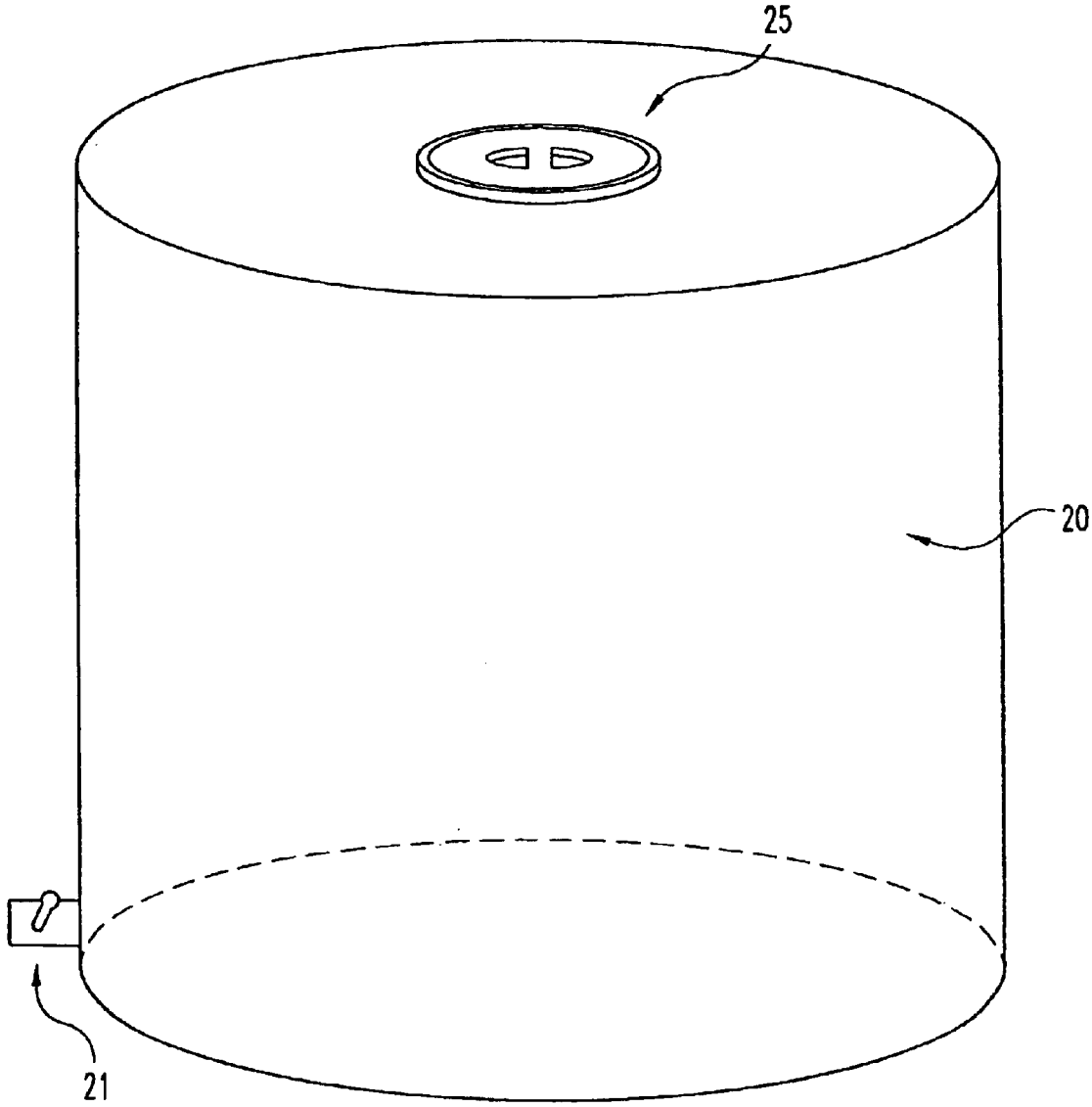
FIG. 1 is a diagrammatic perspective view of a venting lid apparatus of the present invention operationally installed on a portable fluid container.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may better utilize the teachings of the invention.

Referring now to FIG. 1, there is diagrammatically shown one type of fluid container or tank with which the venting lid apparatus of the present invention, generally designated 25, may be advantageously employed. Tank 20 is transportable on a vehicle between sites and includes a valve outlet 21 through which the fluid contents of the tank can be emptied. Tank 20 frequently will be constructed from a plastic material that is not affected by the corrosive or otherwise aggressive nature of the chemicals potentially stored in the tank. Venting lid apparatus 25, which also may be used with tanks constructed of different materials and with different configurations, aids in preventing fluid from splashing out of tank 20 during transport when arranged as shown in FIG. 1. Apparatus 25 was developed for use with large tanks requiring large access openings, which tanks typically have a capacity to hold 1500 gallons or more, but may be adapted for smaller tanks in which its beneficial venting capabilities are required.

Figure 2:
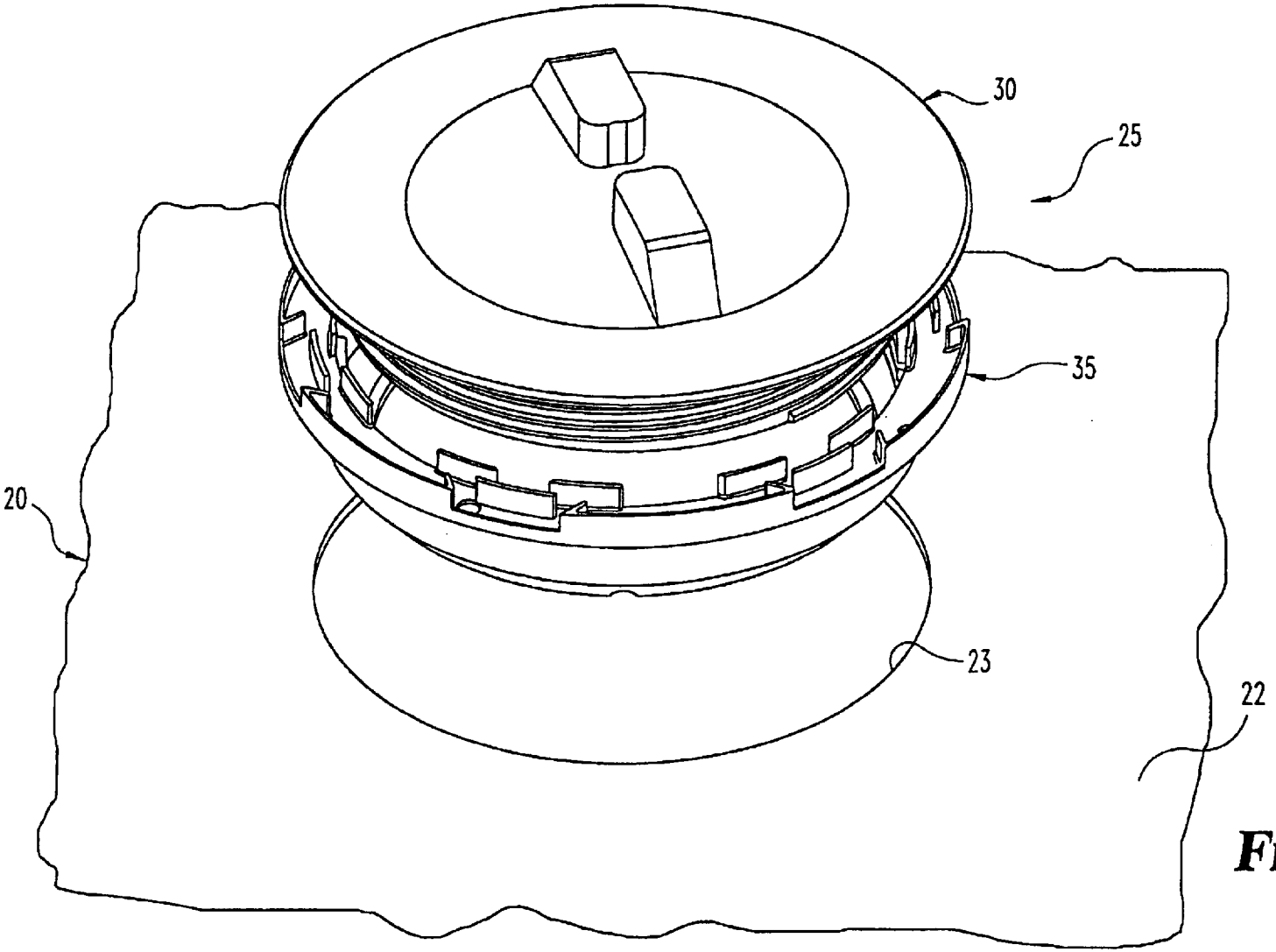
FIG. 2 is a perspective view of an exemplary embodiment of the venting lid apparatus of FIG. 1 prior to its mounting to the partially shown fluid container, wherein the cap is shown disengaged from the installation ring.
Figure 3:
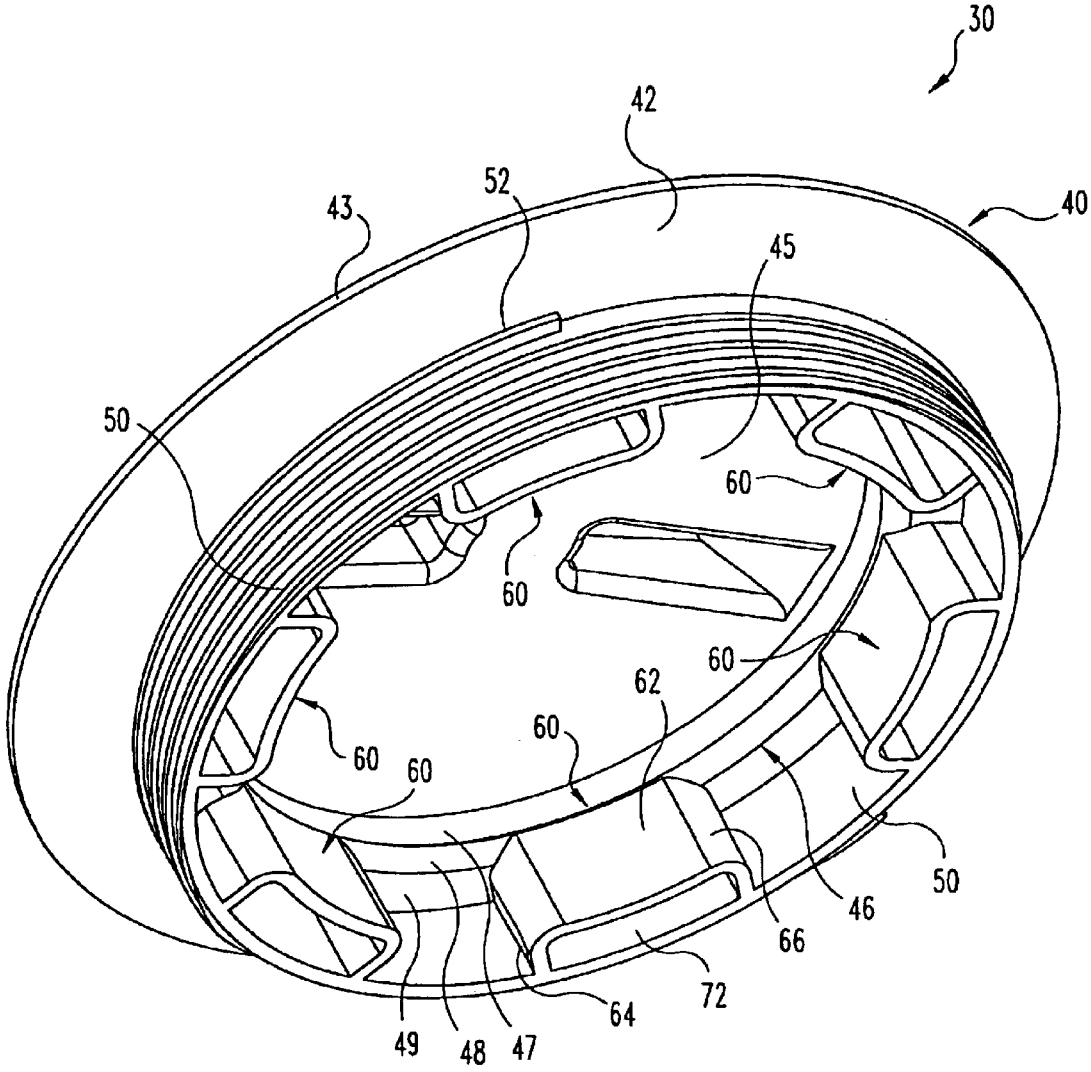
FIG. 3 is a bottom perspective view of the cap of FIG. 2.

With additional reference to the exploded view of FIG. 2, venting lid apparatus 25 in the exemplary embodiment is a two-part assembly formed of a cap 30 and a cap-receiving installation ring 35. The two-part design allows for installation on any tank without requiring any special threads or other attachments be on the tank around a hole through the tank wall. With fasteners such as self-tapping screws that are not shown in FIG. 2, installation ring 35 is attachable to the top wall 22 of tank 20 around a circular wall opening 23 through which fluid and other materials may be introduced into the interior volume of the tank. Apparatus 25 can be adapted for both large and small sized tank openings, but is especially useful with larger diameter openings in tanks, such as within the range of 8 to 24 inches, and more typically within the range of 14 to 24 inches, which larger diameter openings are designed to facilitate rinsing or cleaning of the tank, as well as the introduction of additives, mainly in solid or powdered form, to be mixed in the tank with the liquid being stored in the tank. When cap 30 is screwed downward onto the wall-attached ring 35, venting lid apparatus 25 serves to impede if not prevent fluid from splashing out of tank 20 through opening 23, while at the same time, without human intervention, allows air to enter or exit the tank interior to thereby vent the tank. The design of apparatus 25 described below allows it to be made with venting capabilities that accommodate fluid flows from the tank through outlet 21 in the several hundred gallons a minute range.

With additional reference now to the various views of the cap alone in FIGS. 3, 4, 5 and 6, a preferred configuration of cap 30 is further described. Due to the fact that in the preferred embodiment shown the cap and installation ring are generally of circular shape, to facilitate explanation the terms axial, radial and angular, or derivatives thereof, are used in the application to describe the three different dimensions of spatial location, and such terms alone do not mean that a part is circular, or arcuate or tubular or the like. For example, the terms "radially inward" and "radially outward" refer to a relationship of the positions of the referenced parts relative to a line extending in the axial direction through the center of the article, and do not necessarily mean that either of the parts has a circular shape, or that the parts lie on a single line extending in a radial direction from the axially extending line through the center. In particular, when a first part is spaced a greater distance from the centerline of the object than is a second part, if those first and second parts also lie along a line that transversely extends from the centerline, then the first part is not only radially outward of that second part, but is also in angular and axial alignment with that second part.

Cap 30 is configured to be formed, such as via an injection molding process, with a one-piece or unitary construction. One suitable material of construction is polyethylene plastic, which tank 20 is frequently made from and which therefore does not react with the types of materials contained in such tank.

As its axially upper or top surface, cap 30 includes a disc-shaped cover, generally designated 40, that has a planar, annular region 42 forming its outer radial periphery. Cover 40 may be made in large sizes to cover larger size tank openings, such as about an eighteen inch diameter or a twenty-four inch diameter opening. Although covers for even larger diameter openings are possible, such larger diameter covers may prove unwieldy in the field. Covers 40 may also be made in smaller sizes to cover smaller size tank openings, such as about a ten inch diameter or an eight inch diameter opening, but covers and their associated rings sized for openings having diameters smaller than eight inches would provide a more limited venting that may be inadequate for some applications. Cover 40 also includes a pair of upstanding grips 44 that upwardly project from a bowed upward, central region 45 which is ringed by annular region 42. The above use of the term annular, as well as its use elsewhere in this application, is intended to refer merely generally to the shape, and therefore references any object or region with a shape having a hole in the middle, which hole, as well as the shape of the outer periphery of such object or region, need not be circular.

Axially depending from the underside of cover 40 is the portion of cap 30 adapted for mounting to the installation ring 35 in the preferred embodiment. In the shown embodiment, a stepped collar, generally designated 46, directly depends from cover annular region 42 and includes an upper ring 47 with an outward turned lower end 48 from which extends in a substantially radial direction lower ring 49. The mounting portion of cap 30 is provided with the step collar 46 in a preferred embodiment to provide an additional air flow path to the air manifold as further described below, but such step collar may be eliminated in alternate embodiments. An annular mounting flange 50 in the form of a cylindrical tube section extends downward in an axial direction from the outer extent of lower ring 49 at a location radially inward of the outer edge 43 of cover annular region 42.

Mounting flange 50 is equipped with a fastener used to secure cap 30 to installation ring 35. The shown fastener is a set of double lead threads 52 formed on the outer radial periphery of flange 50, which threads extend continuously around the circumference of flange 50 and along the entire flange height. Other types of fasteners that engage the installation ring, including a different screw design or a bayonet fitting or a latching mechanism that utilizes spring loaded protrusions which nest in undercuts, could be substituted for threads 52 within the scope of the invention, but the threads are preferred in part due to their low cost. In addition, the relative placement of the fasteners on the cap or on the ring may be reversed.

While an internal engagement of the cap mounting flange with the installation ring annular wall is preferred to secure together cap 30 and ring 35, other fastening systems may be employed. For example, cap 30 could attach to ring 35 above the tank wall, such as with externally accessible hooks or latches, such as an over the center style latch. Cap 30 could alternatively be operatively mounted to the ring by being fastened, such as with a latch, to the tank or a fitting thereon while being positioned on the ring.

Figure 4:
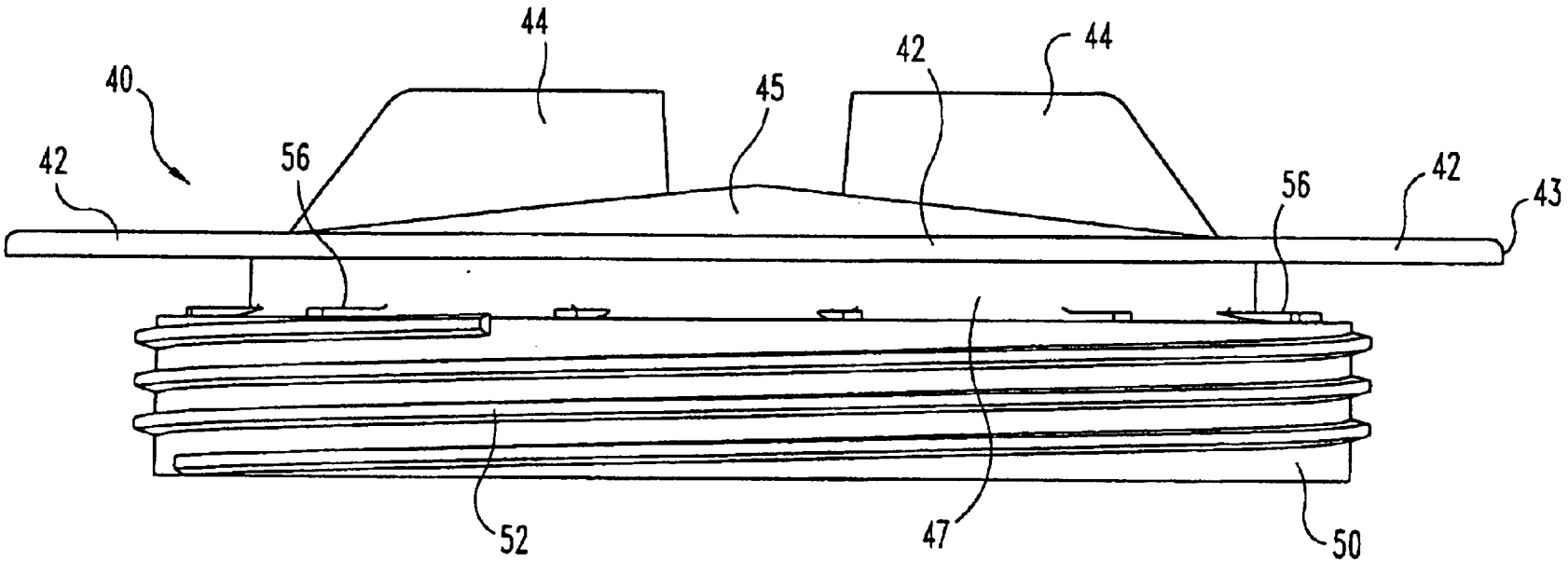
FIG. 4 is a front view of the cap of FIG. 2.
Figure 5:
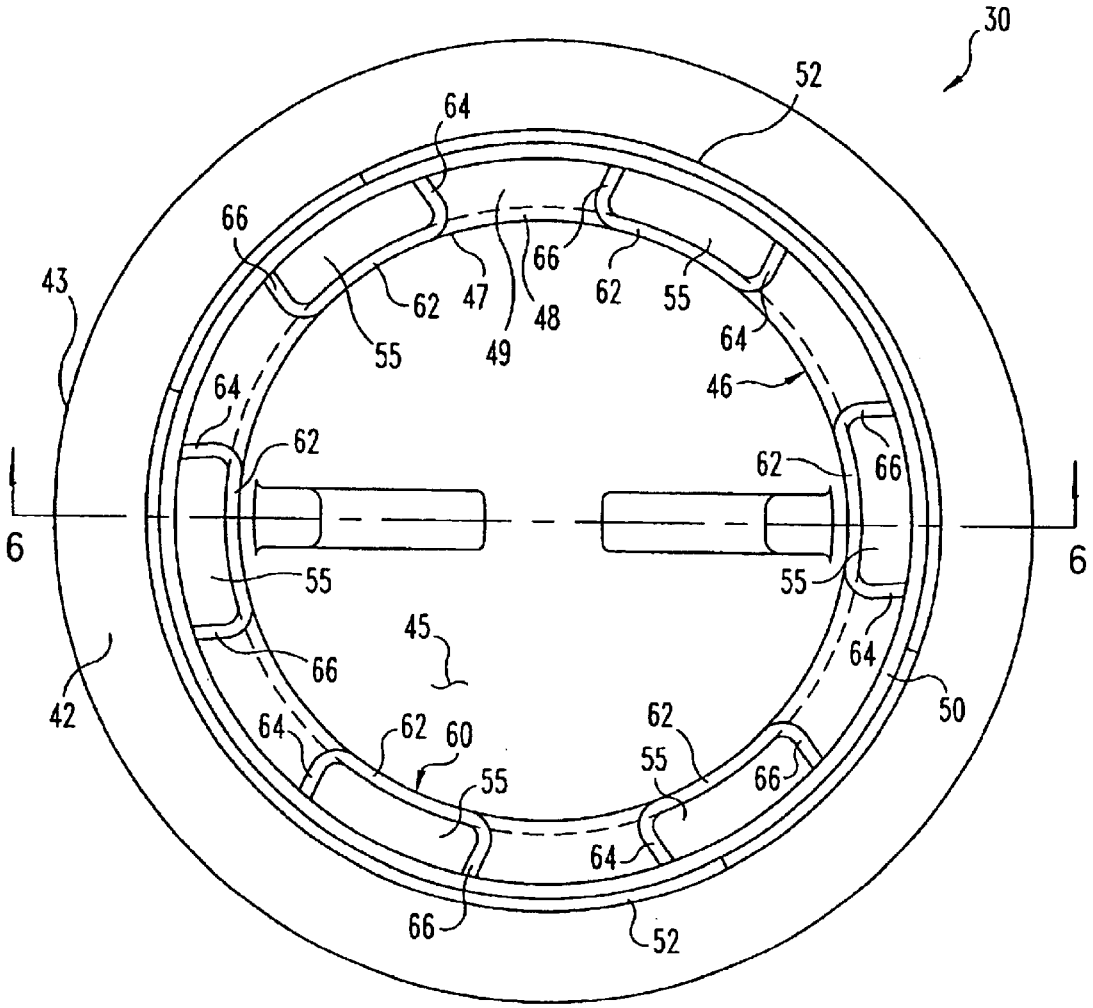
FIG. 5 is a bottom view of the cap of FIG. 2.

To promote venting through the tank opening 23 when cap 30 is attached to ring 35, vent holes or openings are provided in the mounting member portion of the cap. As best shown in FIG. 5, six elongate vent holes 55 that open in an axial direction are formed in lower ring 49 of stepped collar 46. Vent holes 55 are angularly spaced at even intervals around the circumference of lower ring 49. As shown in FIG. 4, at each angular end of each vent hole 55, upstanding ribs 56 formed on the upper surface of lower ring 49 and that radially extend between upper ring 47 and mounting flange 50 are provided to decrease the chance that fluid swirling in the tank radially could escape through the lid by helping to limit to a vertical direction the direction in which fluid can travel to exit from beneath the lid.

Figure 6:
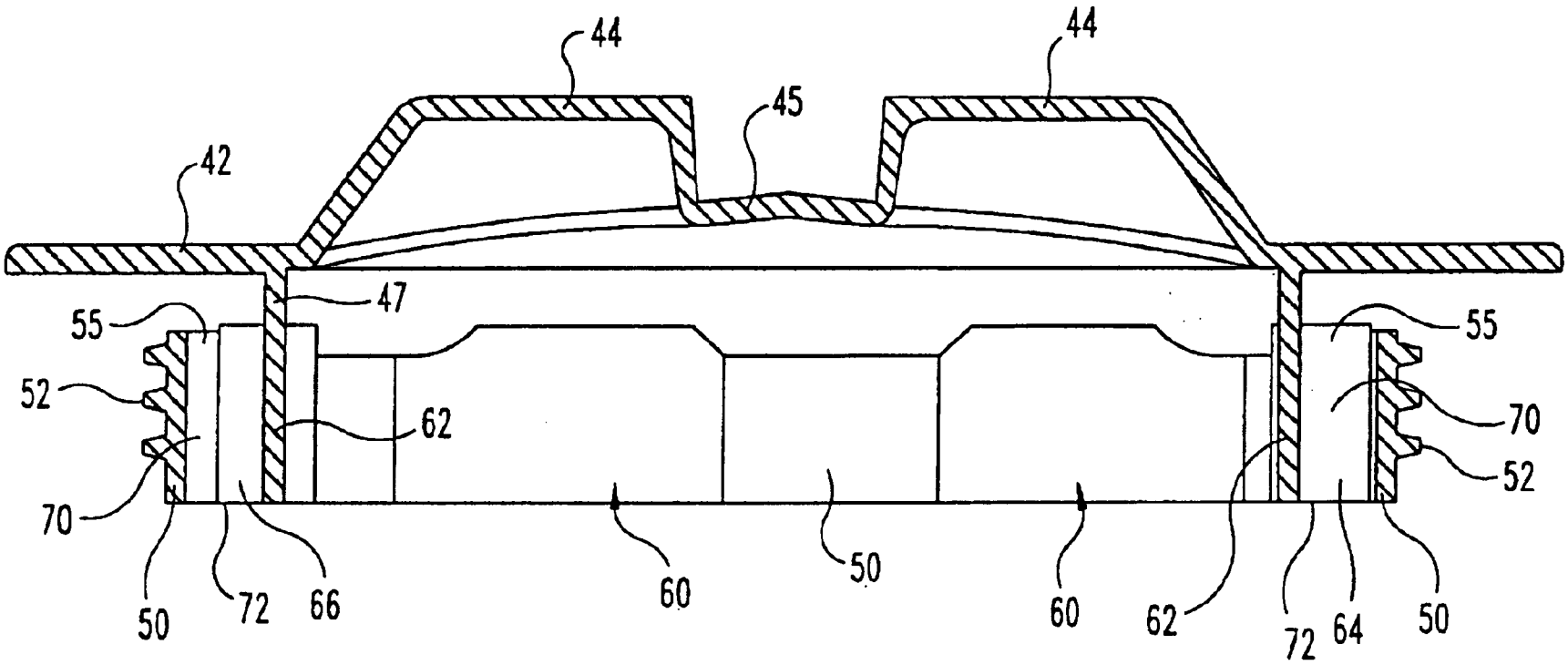
FIG. 6 is a cross-sectional view taken along line 6—6 of FIG. 5.

To limit fluid that may be splashing upward under the center of cover portion 40 during use from entering vent holes 55, a splash guard is provided for the vent holes 55. In the shown embodiment, a separate splash guard 60 is provided for each vent hole 55. Each splash guard 60 includes a baffle section 62 and side wall sections 64 and 66. Baffle section 62 is provided as a downward extension of upper ring 47 of stepped collar 46, which extension reaches to the level of the base of mounting flange 50. While the shown configuration is preferred, shorter or taller baffles may be employed. For example, taller baffles may make fluid escape even more difficult, but such taller baffles increase the height of the lid, which is undesirable when the overall profile of the lid is to be kept low. Side wall section 64 radially extends between a side edge of baffle section 62 and the inner face of mounting flange 50, and side wall section 66 similarly radially extends between the other side edge of baffle section 62 and mounting flange 50. As shown in FIG. 6, side wall sections 64, 66, baffle section 62 and mounting flange 50 together define a venting chamber, or air manifold, 70 opened only at its top end at vent hole 55 and at its bottom end at 72.

The shown number and arrangement of venting holes is preferred, but may be altered by a skilled artisan within the scope of the invention. For example, provided suitable venting capacity is provided, fewer holes may be used, and similarly additional holes may be used if the rigidity of cap 30 is not compromised. Moreover, the vent holes 55 may be incorporated into annular flange 50, such as along its upper edge, or, and preferably with the splash guard being moved radially inwardly so as to extend directly from the underside of the cover behind the vent holes, the vent holes may be incorporated into upper ring 46.

Figure 7:
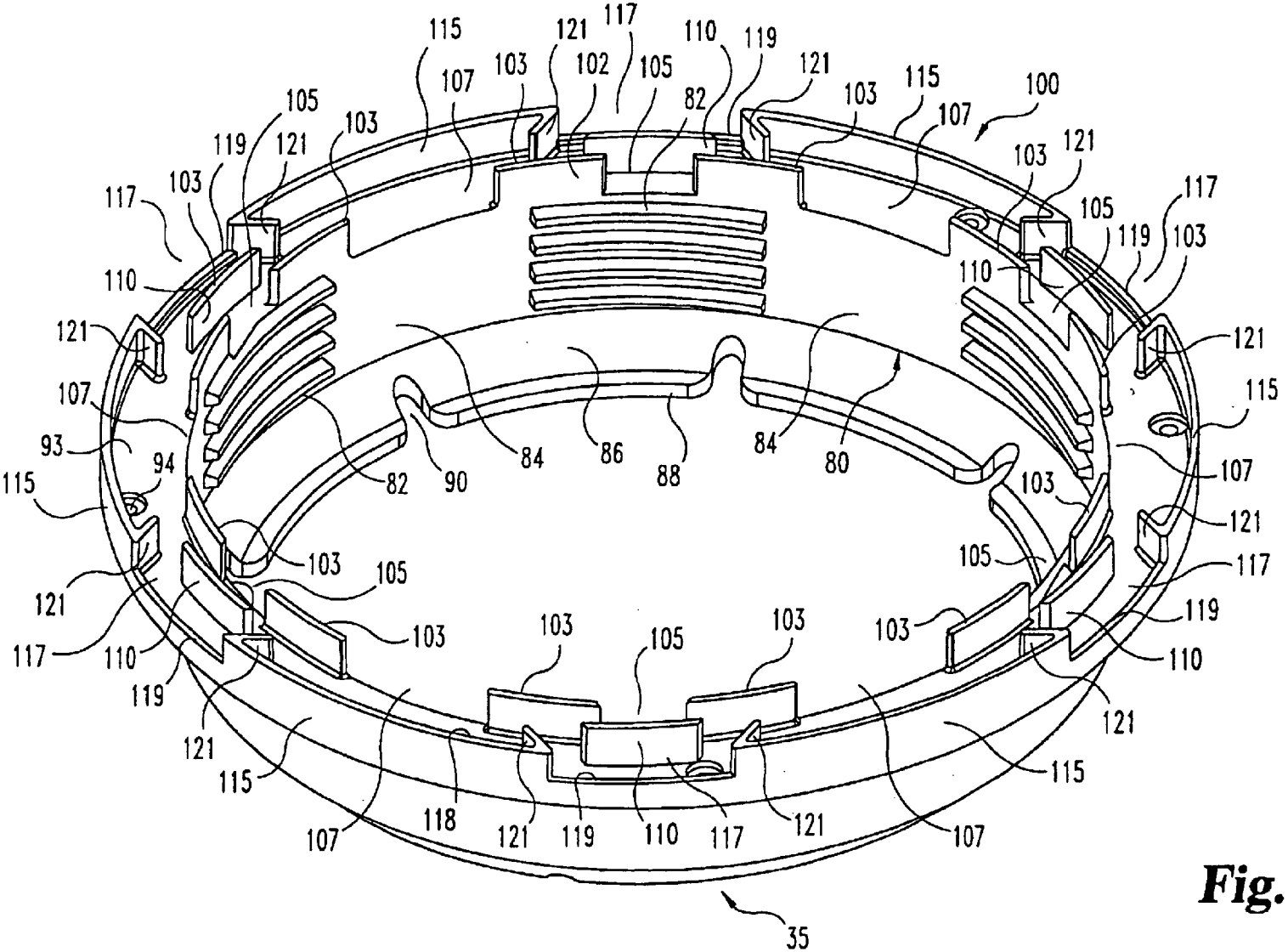
FIG. 7 is a top perspective view of the installation ring of FIG. 2.
Figure 8:
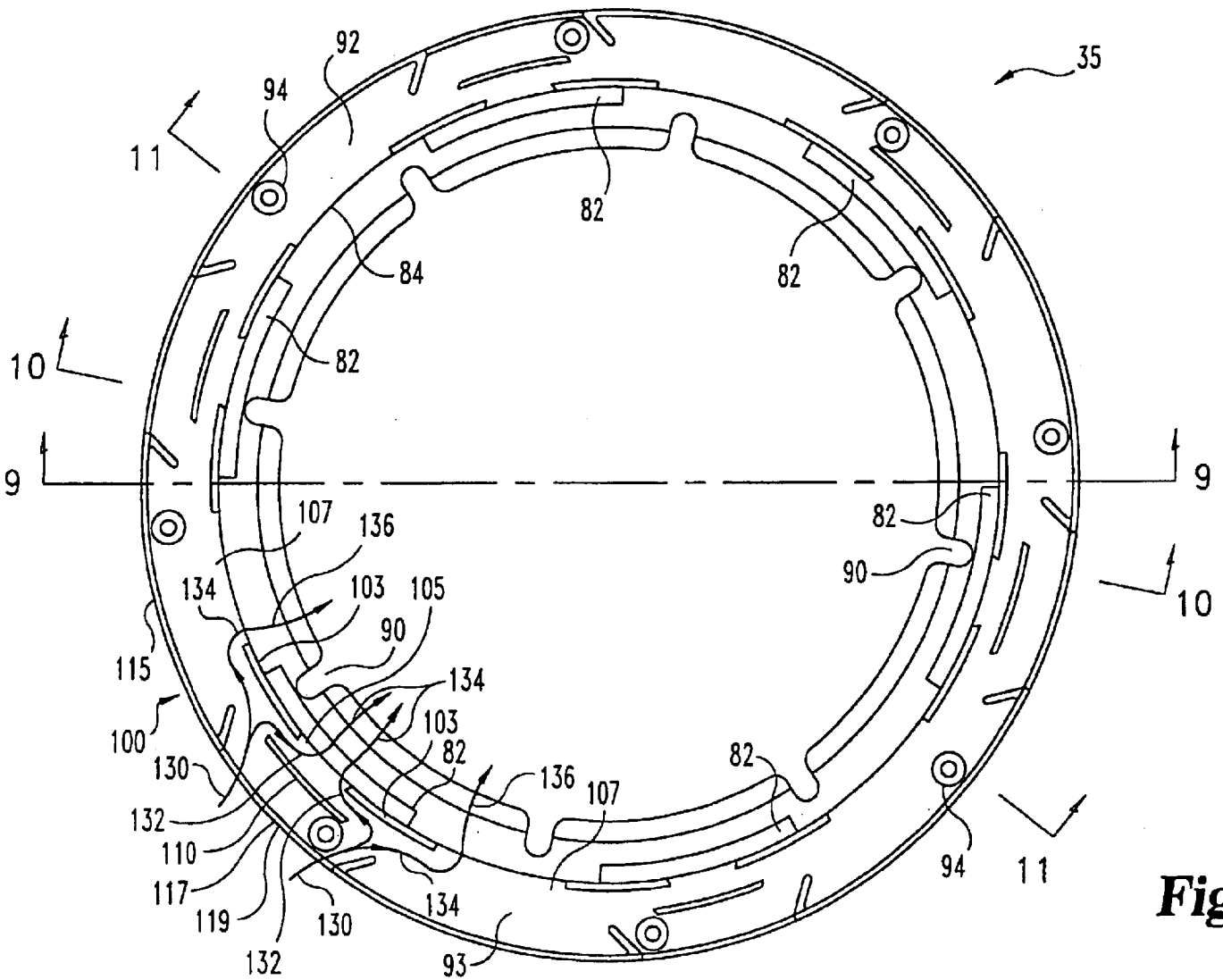
FIG. 8 is a top view of the installation ring of FIG. 2.
Figure 9:
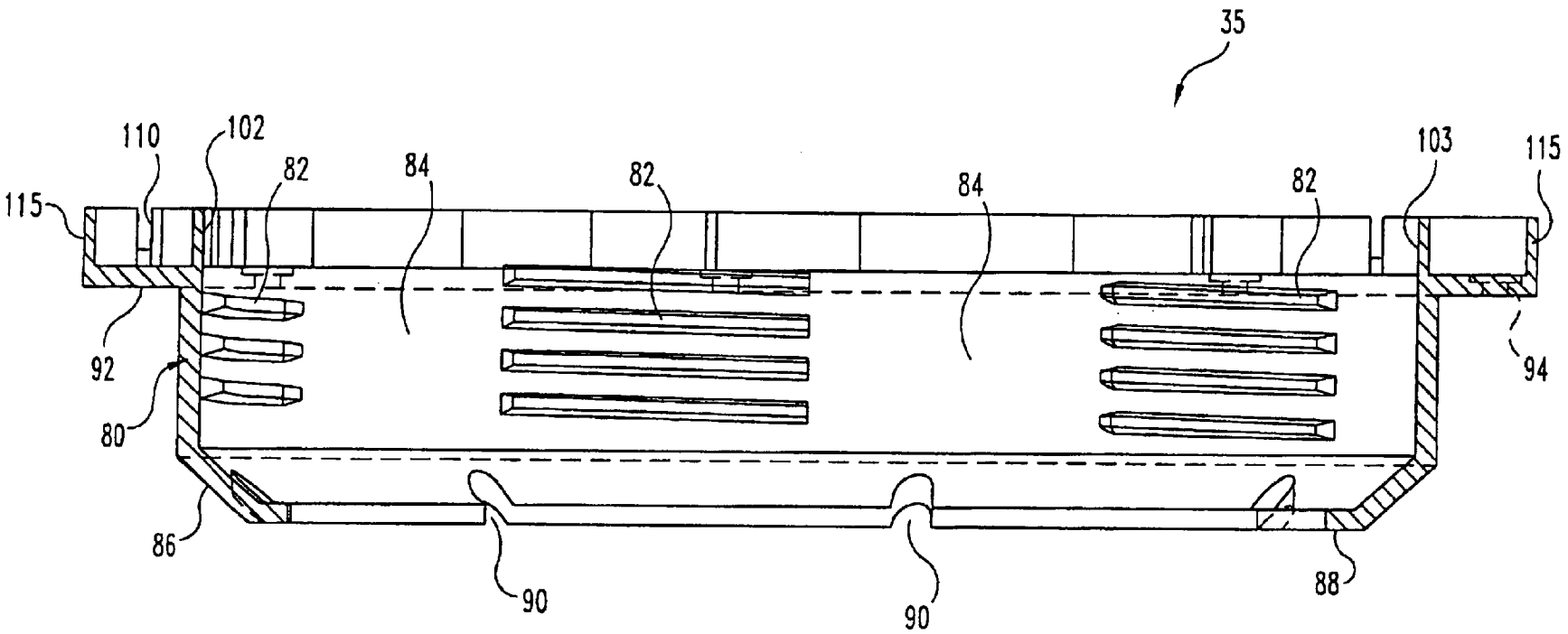
FIG. 9 is a cross-sectional view taken along line 9—9 of FIG. 8.

With additional reference now to the various views of the installation ring alone in FIGS. 7, 8 and 9, a preferred configuration of installation ring 35 is further described.

Ring 35 has a one-piece or unitary construction that is formed from the same plastic material as cap 30 via an injection molding process. Although shown in the Figures as being one part of a two-part assembly forming venting lid apparatus 25 which is distinct from and attachable to tank 20, in an alternate embodiment the desired features of installation ring 35 may be integrally formed as part of the tank wall around a tank opening.

Ring 35 includes an annular wall 80 formed of a cylindrical tube section with a central opening in which the lower end of cap 30 is designed to insert. The outer radial periphery of tube section 80 is smooth and is sized to freely insert within tank wall opening 23 during installation of ring 35 onto tank 20. Tube section 80 is adapted to engage the fastener provided on cap 30 to mount cap 30 to ring 35. The shape of ring 35 and its central opening is shown as being circular as that shape best suits the screw-type attachment with the cap described below that involves a relative rotation between the parts, but especially when other attachment features are used to mount the cap to the ring, different shapes may be employed.

To correspond to the cap configuration of FIGS. 3–6, the radially inner surface of tube section 80 is formed with threads 82 configured to engage cap threads 52. Threads 82 are continuous around the circumference of tube section 80 except for interruptions at six angular locations evenly spaced around that circumference, which interruptions result in six angularly spaced segments 84 of tube section 80 being without threads along their entire axial heights. Threadless tube section segments 84 are radially spaced from portions of cap threads 52 angularly and axially aligned therewith to provide an air venting path as described further below. Each threadless tube segment 84 is shown as spanning approximately the same portion of the circumference as each of the six segments of the tube section threaded at 82. In alternate embodiments, although less desirable from an air venting standpoint, the thread interruptions may be smaller in circumference or eliminated altogether.

An inwardly slanted wall section 86 extends from the lower end of tube section 80 and terminates at its own lower end with a radially inwardly extending annular lip 88. Wall section 86 and lip 88 project inwardly beyond the innermost extent of threads 82 and are formed to include eight curved notches 90 spaced evenly around their circumferences. Wall section 86 and lip 88 serve to support the top rim of a not shown mesh basket that can be inserted into installation ring 35 from outside of the tank 20 and filled with materials that are to be dissolved into the liquid to be introduced and stored in the tank. Notches 90 accommodate ribs extending from the basket top rim which form the framework on which the mesh of the basket is secured.

A projecting lip 92 extends generally radially outward from the upper end of tube section 80 and is used to mount installation ring 35 to tank 20. Mounting lip 92 forms an annular surface that overlays and is supported by the tank top wall 22 around opening 23. A not shown annular gasket that provides a fluid tight seal may be positioned between the underside of lip 92 and tank wall 22. Eight angularly spaced and countersunk holes 94 through mounting lip 92 receive not shown fasteners, such as self-tapping screws or rivets, that extend downward into or through tank wall 22 to fixedly secure installation ring 35 to tank 20. When self-tapping screws are used as the fasteners, top wall 22 need not be formed with screw holes around wall opening 23, but top wall 22 normally will include preformed rivet-accommodating holes (not shown) around wall opening 23 when rivets are used as the fasteners. Other configurations that allow tank mounting of tube section 80, such as fastener receiving ears that radially project from tube section 80, may alternatively be employed.

In the shown embodiment, lip 92 forms a base of an annular manifold, generally designated 100, through which venting air passes into and out from the tank via apparatus 25. Air manifold 100 includes an inner radial wall 102 at the inner periphery of mounting lip 92 which upwardly extends therefrom in alignment with the inner surface of annular wall 80. In alternate embodiments, inner radial wall 102 may be differently located, such as inward of the inner surface in embodiments where the threads are differently constructed or fasteners other than threads are used to mount the cap. Manifold wall 102 is formed by a series of upstanding arcuate ribs 103 that are spaced around the lip circumference at one of two distances apart to define rectangular gaps or openings through which air may pass during use. Six of the wall openings, each designated 105, are defined by ribs 103 that are spaced apart the shorter of the two rib separating distances. Openings 105 are angularly spaced around the manifold circumference such that a different opening 105 is aligned above each of the circumferential segments of tube section 80 that is threaded at 82. Openings 105 are preferable circumferentially centered above threaded sections 82. A second set of inner wall openings includes six larger openings, each designated 107, which are each defined by ribs 103 spaced apart the larger of the two rib separating distances. Openings 107 are equally angularly spaced around the manifold circumference such that openings 107 and openings 105 are arranged in an alternating fashion around the inner wall periphery, with each opening 107 being centered between adjacent openings 105. A different opening 107 is aligned above each of the threadless circumferential segments 84 of tube section 80.

The threaded attachment between cap 20 and ring 35 is configured such that when cap 20 is fully tightened down on installation ring 35 for use, vent openings 55 in cap 20 are brought into registration with inner wall openings 107 such that vent openings 55 are disposed in angular alignment with, and preferably angularly centered on, wall openings 107 to provide air flow communication.

Air manifold 100 further includes a set of six, circumferentially spaced diverter elements, each referenced at 110, that function to interfere with splashout of fluid from within the tank which may reach manifold 100 at openings 105. Each diverter element 110 is formed by an arcuate ridge that upwardly extends from the annular top surface 93 of lip 92 at a radial position between walls 102 and 115 and in angular alignment with a different manifold wall opening 105. Each diverter element 110 has a sufficiently large angular length to cover the angular span of opening 105 in that no portion of the angle spanned by opening 105 is not also spanned by its corresponding diverter element 110.

The radially outer wall of annular manifold 100 is formed by an annular ridge 115 that upwardly extends from the outer periphery of mounting lip 92. Openings 117 through outer wall 115 are provided to allow air to enter into and escape from the manifold air passageways during tank venting. The shown embodiment employs six openings 117 evenly angularly spaced around the manifold circumference, but so long as sufficient space is provided for an acceptable quantity of air flow, fewer or greater number of openings may be employed. The six openings 117 are each angularly spaced from openings 107 so fluid which may reach opening 107 cannot pass directly radially outward to escape from manifold 100.

Openings 117 are formed in the shown embodiment by downwardly extending notches in the upper edge 118 of wall 115, which notches do not extend the entire wall height so as to leave a lip section 119 that upwardly extends above top surface 93 of mounting lip 92. Lip sections 119 aid in holding back fluid which may collect on top surface 93 after reaching air manifold 100 from tank 20. At each opening 117, the outer wall portions defining the ends of the openings are each formed with an inwardly angled segment 121 to divert fluid which might enter the area by the outer wall 115 from moving toward opening 117.

Figure 10:
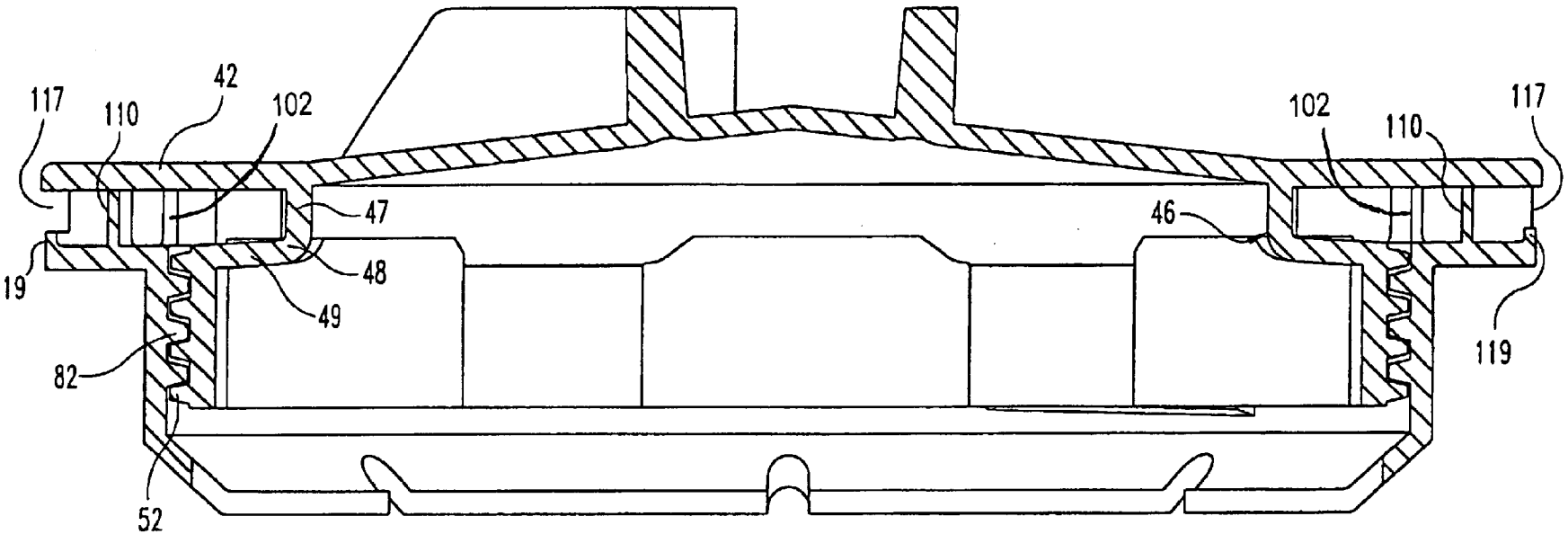
FIG. 10 is a cross-sectional view, as conceptually taken through the installation ring along line 10—10 of FIG. 8, of the venting lid apparatus after the cap has been fastened to the installation ring.
Figure 11:
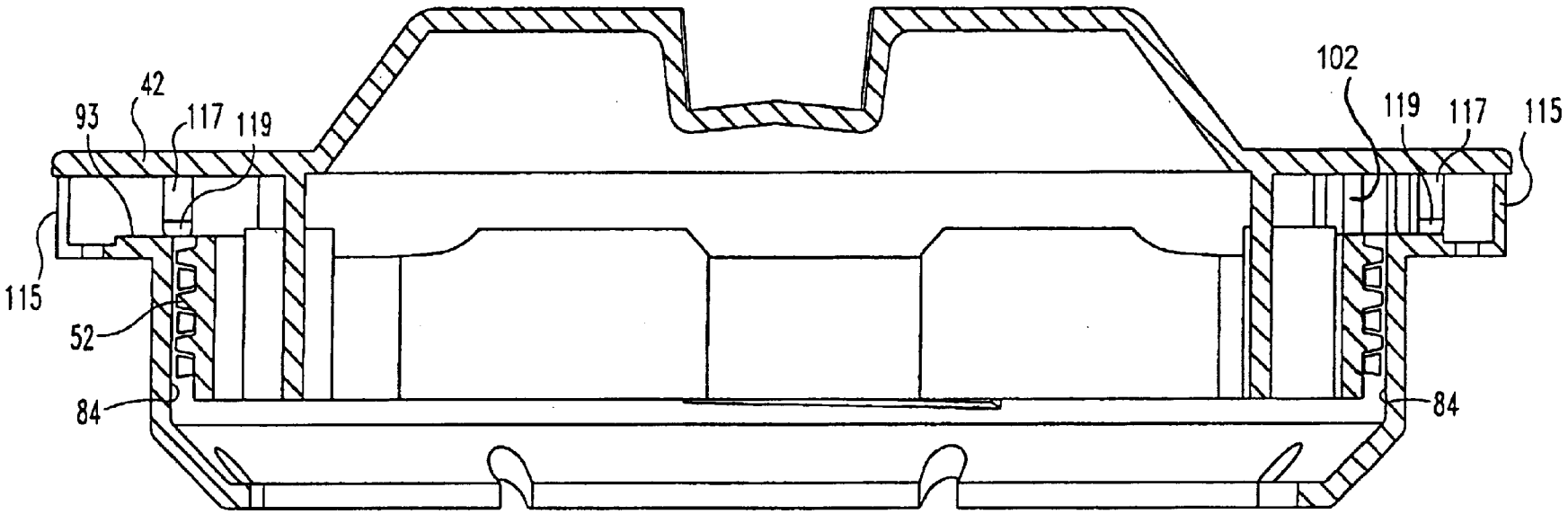
FIG. 11 is another cross-sectional view of the venting lid apparatus as taken along line 11—11 of FIG. 8.

With additional reference to the cross-sectional views of FIGS. 10 and 11, in which lid apparatus 25 is shown fully assembled for covering use, inner wall 102, diverter elements 110 and outer wall 115 of manifold 100 are all the same height and are generally flush with the underside of cover 40 when cap 30 is secured to installation ring 35. Cover 40 thereby forms a top wall of manifold 100 so as to enclose the manifold air passageways in the preferred embodiment.

The shown configuration of air manifold 100 advantageously provides circuitous, internal air passageways between the area where ring 35 and cap 30 are connected, and an area opened to atmospheric air at the exterior of tank 20. The design of the air passageways allows large volumes of air to be moved therethrough while at the same time providing a winding passageway to limit fluid splashout. Other manifold designs with different numbers and shapes of walls and wall openings, as well as diverter plates, may be employed.

The structure of venting lid apparatus 25 will be further understood in view of the following explanation of its use. After installation ring 35 is mounted to tank 20, fluid can be introduced through the central opening of ring 35 and tank opening 23 until the tank is filled to an appropriate level. When tank filling is complete, a user screws cap 30 down onto installation ring 35, such that apparatus 25 is configured as shown in FIGS. 10 and 11.

When tank 20 is transported, fluid may splash upward in tank 20. Any fluid which splashes upward toward the underside of cover 40 in the space radially inward of splash guards 60, or the inner surface of flange 50 between guards 60, has no ability to pass outward and drops downward. Along the circumferential areas of tube section 80 which are threaded at 82, fluid which may splash upward into the space between cylindrical tube section 80 of ring 35 and annular wall 50 of cap 30 encounters a threaded engagement between ring threads 82 and cap threads 52. This threaded engagement is not air or fluid tight, but provides a highly circuitous route for fluid to escape upward. Any fluid which does reach the top of section 80 through the threaded engagement and passes radially outward through an opening 105 is not free to splash directly radially outward through opening 117 in the outer wall, as diverter plate 110 blocks such path, and the fluid collects on top surface 93 of lip 92. Along threadless portions 84 of tube section 80, any fluid which splashes upward between wall section 80 and the cap annular wall 50, or which splashes upward through vent chambers 70 and vent openings 55, may reach a height at which it may pass radially outward through opening 107. Such fluid also collects on top surface 93 as it cannot splash directly radially outward due to the presence of outer manifold wall 115. Lip portions 119 form a retaining ring around the outer periphery of lip 92 to hold back fluid collected on surface 93, and collected fluid may flow under gravity back through the various openings 105 and 107 to drain back into tank 20.

When a site is reached where tank 20 is to be emptied, a user can drain the tank via outlet 21 without adjusting venting lid apparatus 25. During tank emptying, outside air vents through lid apparatus 25 to fill the tank interior volume previously occupied by the outlet fluid. The air vents through apparatus 25 into the tank in the following manner, generally shown by the arrows in FIG. 8, which arrows are representative of the air intake at each of the six outer wall openings 117 in air manifold 100. Specifically, air flows radially inward at 130 through openings 117 and enters the annular chamber of manifold 100. Air flows within the chamber along the top surface 93 of lip 92 and under cap cover 40. The portion of the inlet air which travels between the diverter plates 110 and ribs 103 at 132 passes through inner wall opening 105. Air passing through opening 105 is free to pass downward between the cap and the installation ring over the threaded engagement therebetween as shown at 134, or, alternatively, can travel in a not shown fashion in an angular direction within the annular volume between the manifold inner wall 102 and the not shown cap collar 46 to vent openings 55 described below. The portion of the inlet air which does not bend around diverter plate 110 and which flows at 134 passes through openings 107. Air passing through openings 107 is free to pass downward at 136 either through the gap between the cap and installation ring along the threadless segment 84 of tube section 80, or through vent openings 55 and then vent chambers 70 down into the interior of the tank.

The foregoing design allows for high air flow due to the large cross-sectional area of the venting passageways of the manifold. This venting area is less a function of the dimensions of the openings in the inner and outer walls of the manifold than the dimensions of the restrictions that define portions of the passageway within the manifold, due to the fact that unless the manifold is made with a wide radial dimension, the wall openings can be designed larger than the passageway portions defined by the restrictions. In the preferred embodiment, to maximize air flow, the cross-sectional area of the air flow passageway portion between diverter elements 110 and inwardly angled segments 121 is approximately the same as the sum of the cross-sectional areas of the passageway portions formed by diverter elements 110 with ribs 103, and inwardly angled segments 121 with ribs 103. Since frictional forces resisting air flow have a more marked effect with flows in a smaller cross-sectional area than with flows in a larger cross-sectional area, it is more preferable for the sum of the cross-sectional areas formed by elements 110 and ribs 103 and by ribs 103 and segments 121 to be slightly larger than the area formed by elements 110 and segments 121 to offset potential frictional effects.

Figure 12:
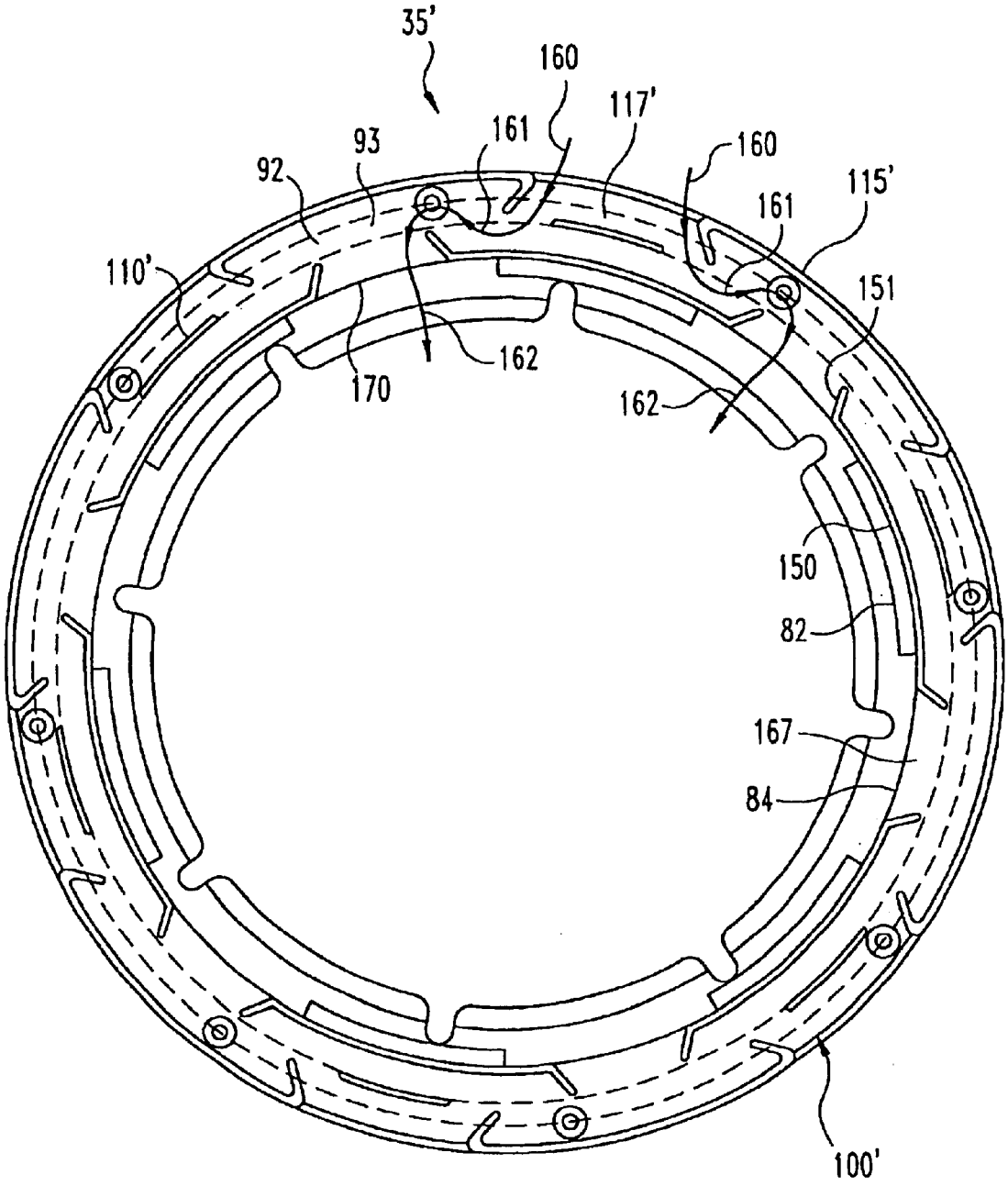
FIG. 12 is a top view of an alternate embodiment of the installation ring.

An alternate embodiment of the invention is shown in FIG. 12. The ring 35' is similar to the installation ring 35 depicted in FIG. 8; however, this alternate embodiment employs a vent deflection rib 150 instead of the rib 103 and wall opening 105 of the prior embodiment. The deflection ribs 150 are angularly spaced around the manifold circumference such that the deflection ribs 150 are preferably circumferentially centered above threaded sections 82. The vent deflection rib 150 includes outwardly angled segment 151 at each end. The segments 151 are spaced apart to define a set of inner wall openings 167. Like the ribs, the openings 167 are equally angularly spaced around the manifold circumference, with each opening preferably aligned above a corresponding threadless circumferential segment 84.

The vent deflection rib 150 prevents fluid escaping through openings 117', while maintaining the vent to the atmosphere. Angled segments 151 divert fluid toward outer wall 115', which forces the fluid to follow a circuitous path toward opening 117. Likewise, vented air follows the same circuitous path, with no "line of sight" along the path. Specifically, air flows radially inward at 160 through openings 117' and enters the annular chamber of ring 35' and manifold 100'. The air flow must then change direction to a circumferential path when deflected by the diverter element 110'. The flow travels along the top surface 93 of lip 92 and under cap cover 40. The portion of the inlet air which travels between the vent deflection rib 150 and the outer wall 115' at 161 passes through inner wall opening 170. Air passing through openings 170 is free to pass inward and downward at 162 either through the gap between the cap and installation ring along the threadless segment 84 of tube section 80, or through vent openings 55 as shown in FIGS. 5–6 and down into the interior of the tank.

In an alternate embodiment of the present invention, the air manifold with the circuitous venting passageways may be defined by parts of the cap instead of the installation ring. For example, the apertured inner and outer radial walls of the manifold, and the splashout preventing diverter elements between these walls, may be formed as depending flanges on the underside of the cover. For such an embodiment, the air manifold base or bottom wall may be an annular lip of the installation ring, or may be the top wall of the tank, such as if the tank wall around its opening was suitably formed to engage the cap and the installation ring was eliminated. In still another embodiment, different portions of the air manifold apertured walls and diverter elements, or different ones of the apertured walls and diverter elements, may be formed on the cap and the installation ring.

While this invention has been shown and described as having multiple designs, the present invention may be further modified within the spirit and scope of this disclosure. For example, the walls or projections that define the inner and outer radial walls of the air manifold, and the diverter elements, need not be arcuate or concentrically arranged. These parts may be otherwise formed, such as straight or angled, and can be arranged such that no straight path exists between openings in the inner and outer radial walls. In an alternate embodiment, the inner wall can be formed of the inward ends of a series of ribs, which ribs extend outwardly at an angle relative to the radial direction, and which may lead to diverter members arranged orthogonally to the inner wall ribs. With such inner wall, the outer wall can be formed of the outward ends of a series of outer ribs, which outer ribs extend inwardly at an angle relative to the radial direction and toward the length of the inner wall ribs so as to provide herringbone arrangement. This application is therefore intended to cover any variations, uses, or adaptations of the invention using its general principles. Further, this application is intended to cover such departures from the present disclosure as come within known or customary practice in the art to which this invention pertains.

What is claimed is:

1. A venting lid apparatus for a fluid container, comprising:

a cap including a cover portion and an insert member depending from said cover portion, said insert member including a plurality of circumferentially spaced vent holes;

a cap receiving element being associated with the fluid container, said cap receiving element defining an aperture into which said cap insert member is located;

wherein said cap receiving element defines an air manifold including a first surface and a second surface radially outward of said first surface, wherein said first surface defines a plurality of first openings, and radially outwardly angled surfaces at opposite sides of each of said plurality of first openings, said plurality of first openings being in air flow communication with and aligned with said vent holes when said cap receiving element and said cap are in interfitting engagement, said second surface defining at least one second opening being in air flow communication with and offset from said plurality of first openings.

2. The venting lid apparatus of claim 1 wherein said at least one second opening includes a plurality of second openings.

3. The venting lid apparatus of claim 2 wherein said first and second surfaces define a circumferential channel therebetween in communication with said plurality of first openings and said plurality of second openings; and said air manifold includes a plurality of circumferentially extending diverter elements disposed within said channel, each said diverter element being in alignment with and radially inward of a corresponding one of said second openings.

4. The venting lid apparatus of claim 1 wherein said cap receiving element is integrally formed with the fluid container.

5. The venting lid apparatus of claim 1 wherein said cap receiving element is separate from and attachable to the fluid container.

6. The venting lid apparatus of claim 1, wherein said second surface defines radially inwardly angled surfaces at opposite sides of said at least one second opening.

7. The venting lid apparatus of claim 6, wherein said radially inwardly angled surfaces diverge relative to each other at said opposite sides of said at least one second opening.

8. The venting lid apparatus of claim 1, wherein said radially outwardly angled surfaced converge toward each other at said opposite sides of each of said plurality of first openings.

9. A venting lid apparatus for a fluid container, comprising:

a cap including a cover portion and an insert member depending from said cover portion, said insert member including a plurality of circumferentially spaced vent holes;

a cap receiving element being associated with the fluid container, said cap receiving element defining an aperture into which said cap insert member is located; and wherein said cap receiving element defines an air manifold including a first surface and a second surface radially outward of said first surface, wherein said first surface defines a plurality of openings and a plurality of gaps, said plurality of openings being aligned with and in air flow communication with said vent holes, said second surface defining at least one second surface opening being aligned with and in air flow communication with said plurality of gaps, said plurality of gaps being offset from said vent holes when said cap is in interfitting engagement with said cap receiving element.

10. The venting lid apparatus of claim 9 wherein said cap receiving element is integrally formed with the fluid container.

11. The venting lid apparatus of claim 9 wherein said cap receiving element is separate from and attachable to the fluid container.

12. The venting lid apparatus of claim 9 wherein said at least one second surface opening comprises a plurality of second surface openings.

13. A venting lid apparatus for a fluid container, comprising:

a cap including a cover portion and an insert member depending from said cover portion, said insert member including a plurality of circumferentially spaced vent hole;

a cap receiving element being associated with the fluid container, said cap receiving element defining an aperture into which said cap insert member is located;

wherein said cap receiving element defines an air manifold including a first surface and a second surface radially outward of said first surface, wherein said first surface defines a plurality of openings and a plurality of gaps, said plurality of openings being in air flow communication with and aligned with said vent holes, said second surface defining at least one second surface opening being aligned with and in air flow communication with said plurality of gaps, said plurality of gaps being offset from said vent holes when said cap is in interfitting engagement with said cap receiving element; and wherein said manifold comprises a plurality of diverter elements each structured and arranged to block fluid from passing outward in a radial direction from said plurality of gaps to said at least one second surface opening.

14. A venting lid apparatus for a fluid container, comprising:

a cap including a cover portion and a mounting member depending from said cover portion, said mounting member including at least one cap fastening element; and a cap receiving element being associated with the fluid container, said cap receiving element including a cap mounting portion and defining an air manifold structured and arranged to deter the escape of liquids from the fluid container, said cap mounting portion defining an opening and adapted to cooperate with said at least one cap fastening element to detachably mount said cap to said cap receiving element when said cap mounting member is interfittingly engaged with said cap mounting portion, at least a portion of said air manifold disposed radially outward of said cap mounting portion, said air manifold including a first surface and a second surface radially outward of said first surface, wherein said first surface defines a plurality of openings and a plurality of gaps, said second surface defining at least one second surface opening being in air flow communication with and aligned with said plurality of gaps for tank venting, said at least one second surface opening being offset from at least one of said plurality of openings.

15. The venting lid apparatus of claim 14 wherein said cap receiving element is integrally formed with the fluid container.

16. The venting lid apparatus of claim 14 wherein said cap receiving element is separate from and attachable to the fluid container.

17. The venting lid apparatus of claim 16 wherein said manifold second surface comprises an axially extending surface that forms an outer radial periphery of said manifold, wherein said at least one second surface opening comprises a plurality of second surface openings, each of said plurality of second surface openings being located in said second surface at a position disposed axially above a base of said manifold over which air flows between said plurality of gaps and said plurality of said second surface openings, wherein a portion of said second surface disposed between said base and each said second surface opening forms a lip to aid in retaining within said manifold fluid that collects on said base.

18. The venting lid apparatus of claim 16 wherein said mounting member includes a plurality of vent holes in air flow communication and aligned with of said plurality of openings when said cap is mounted to said cap receiving element.

19. The venting lid apparatus of claim 18 wherein said cap further comprises a plurality of splash guards axially extending below said cover portion, each of said plurality of splash guards disposed radially inward and in alignment with a different one of said plurality of vent holes.

20. The venting lid apparatus of claim 19 wherein each of said cap and said cap receiving element comprises a one piece construction from plastic.

21. A venting lid apparatus for a fluid container, comprising:

a cap including a cover portion and a mounting member depending from said cover portion, said mounting member including at least one cap fastening element;

a cap receiving element being associated with the fluid container, said cap receiving element including a cap mounting portion and defining an air manifold, said cap mounting portion defining an opening and being adapted to cooperate with said at least one cap fastening element to detachably mount said cap to said cap receiving element when said cap mounting member is inserted within said cap mounting portion opening, said air manifold including a first surface extending in an axial direction and a second surface extending in an axial direction and disposed radially outward of said first surface;

wherein said first surface defines a plurality of first surface openings and a plurality of gaps, and said second surface defines a plurality of second surface openings being aligned with and in air flow communication with said plurality of gaps for tank venting, each said second surface opening being offset from a said first surface opening;

wherein said manifold includes a plurality of axially extending diverter elements each positioned at a radial location between one of said plurality of gaps and one of said second surface openings, each said diverter element being structured and arranged to block fluid from passing outward in a radial direction from one of said gaps to one of said second surface openings.

22. The venting lid apparatus of claim 21 wherein said second surface comprises an axially extending cylindrical surface that forms an outer radial periphery of said manifold, wherein said first surface comprises an axially extending cylindrical surface that forms an inner radial periphery of said manifold.

23. The venting lid apparatus of claim 22 wherein said mounting member comprises a tubular section having a cylindrical outer periphery, and said at least one cap fastening element includes threaded portion on said cylindrical outer periphery that engages at least one thread on an inner surface of said cap mounting portion, and wherein said at least one thread is interrupted at a plurality of circumferential locations to form a plurality of threadless inner surface segments, each threadless inner surface segment being aligned with and disposed axially below a different one of said plurality of first surface openings.

24. The venting lid apparatus of claim 21 wherein said gaps are offset from said vent holes when said cap mounting member is inserted in said cap mounting portion opening.

25. The venting lid apparatus of claim 21 wherein said mounting member includes a plurality of vent holes aligned with said plurality of first surface openings in said first surface when said cap is mounted to said cap receiving element.

26. A venting cap for an opening in a fluid container, comprising:

a cover portion for covering the fluid container opening;

an annular mounting member depending from said cover portion, said annual mounting member including a plurality of vent holes circumferentially spaced around said annular mounting member;

a fastener disposed on said annular mounting member and adapted to detachably mount said cover portion to a complementary fastener portion associated with the fluid container opening, said complementary fastener portion including a base portion structured and arranged to facilitate air flow from the fluid container to and through said plurality of vent holes; and at least one splash guard disposed on said annular mounting member between each of said plurality of vent holes and a center region of said cover portion.

27. The venting cap of claim 26 wherein said at least one splash guard comprises a plurality of baffle portions, wherein a different one of said baffle portions is aligned with each of said plurality of vent holes.

28. The venting cap of claim 27, wherein said base portion further comprising a plurality of first and second walls, wherein a radial gap between each of said baffle portions and said annular mounting member is spanned by a different one of said first walls and a different one of said second walls, wherein said first walls, said second walls, said baffle portions and said annular mounting member are arranged to define a plurality of axially extending vent chambers when said cover portion is detachably mounted to said fastener portion, each said venting chamber having an outlet port in a lower axial end, each said vent chamber being in air flow communication with a different one of said plurality of vent holes.

29. The venting cap of claim 26 wherein said fastener comprises at least one thread, and wherein said plurality of vent holes is located at a height between said cover portion and said at least one thread.

30. The venting cap of claim 26 wherein said annular mounting member is spaced radially inward from an outer radial periphery of said cover portion.

31. The venting cap of claim 26 wherein said cover portion, said annular mounting member, said fastener, and said at least one splash guard are integrally formed in a one piece construction.

* * * * *